US006528474B1

(12) United States Patent
Artiga Gonzalez et al.

(10) Patent No.: US 6,528,474 B1
(45) Date of Patent: Mar. 4, 2003

(54) METHOD OF MANUFACTURING A DETERGENT WITH SOLUBLE BUILDER

(75) Inventors: Rene-Andres Artiga Gonzalez, Duesseldorf (DE); Andreas Lietzmann, Duesseldorf (DE); Maria Liphard, Essen (DE); Wilfried Roehl, Monheim (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 110 days.

(21) Appl. No.: 09/609,832

(22) Filed: Jul. 5, 2000

(30) Foreign Application Priority Data

Aug. 4, 1999 (DE) ..... 199 36 613

(51) Int. Cl.[7] ..... C11D 1/02; C11D 1/83; C11D 3/06; C11D 11/02; C11D 17/06

(52) U.S. Cl. ..... 510/453; 510/337; 510/349; 510/352; 510/359; 510/443; 510/444; 510/456; 510/459; 510/467; 510/495; 510/510; 510/533; 510/534

(58) Field of Search ..... 510/533, 534, 510/337, 349, 352, 359, 443, 444, 453, 456, 459, 467, 495, 510

(56) References Cited

U.S. PATENT DOCUMENTS

| | | | | | |
|---|---|---|---|---|---|
| 2,472,590 | A | | 6/1949 | Kenyon et al. | 260/209 |
| 3,234,258 | A | | 2/1966 | Morris | 260/460 |
| 4,664,839 | A | | 5/1987 | Rieck | 252/175 |
| 4,985,553 | A | | 1/1991 | Fuertes et al. | 536/124 |
| 5,075,041 | A | | 12/1991 | Lutz | 252/548 |
| 5,451,354 | A | * | 9/1995 | Aouad et al. | 264/117 |
| 5,486,317 | A | * | 1/1996 | Dorset et al. | 252/549 |
| 5,494,488 | A | | 2/1996 | Arnoldi et al. | 8/137 |
| 5,541,316 | A | | 7/1996 | Engelskirchen et al. | 510/471 |
| 5,573,697 | A | * | 11/1996 | Riddick et al. | 510/359 |
| 5,580,941 | A | | 12/1996 | Krause et al. | 527/300 |
| 5,703,037 | A | * | 12/1997 | Doumen et al. | 510/444 |
| 5,739,097 | A | * | 4/1998 | Bauer et al. | 510/446 |
| 5,780,420 | A | | 7/1998 | Breuer et al. | 510/466 |
| 5,783,616 | A | | 7/1998 | Krause et al. | 524/58 |
| 5,821,360 | A | | 10/1998 | Engelskirchen et al. | 536/124 |
| 5,830,956 | A | | 11/1998 | Stockhausen et al. | 526/318.2 |
| 5,847,065 | A | | 12/1998 | Krause et al. | 527/300 |
| 5,854,191 | A | | 12/1998 | Krause et al. | 510/276 |
| 5,854,321 | A | | 12/1998 | Krause et al. | 524/58 |
| 5,892,027 | A | | 4/1999 | Moeller et al. | 536/124 |
| 5,922,670 | A | | 7/1999 | Knuebel et al. | 510/426 |
| 6,174,851 | B1 | * | 1/2001 | Harth et al. | 510/444 |
| 6,207,635 | B1 | * | 3/2001 | Adams et al. | 510/444 |

FOREIGN PATENT DOCUMENTS

| | | | |
|---|---|---|---|
| DE | 42 21 381 | | 2/1994 |
| DE | 43 00 772 | | 7/1994 |
| DE | 43 21 022 | | 1/1995 |
| DE | 44 00 024 | | 7/1995 |
| DE | 44 02 851 | | 8/1995 |
| DE | 44 17 734 | | 11/1995 |
| DE | 43 03 320 | | 12/1995 |
| DE | 44 26 443 | | 2/1996 |
| DE | 44 42 977 | | 6/1996 |
| DE | 44 43 177 | | 6/1996 |
| DE | 195 03 061 | | 8/1996 |
| DE | 195 07 717 | | 9/1996 |
| DE | 195 13 391 | | 10/1996 |
| DE | 196 00 018 | | 7/1997 |
| DE | 196 16 769 | | 11/1997 |
| DE | 196 16 770 | | 11/1997 |
| DE | 19858887.9 | | 12/1998 |
| DE | 19912679.8 | | 3/1999 |
| EP | 0 164 514 | | 12/1985 |
| EP | 0 232 202 | | 8/1987 |
| EP | 273688 | A1 * | 7/1988 |
| EP | 0 427 349 | | 5/1991 |
| EP | 0 472 042 | | 2/1992 |
| EP | 0 542 496 | | 5/1993 |
| EP | 0 727 448 | | 8/1996 |
| EP | WO 99/03964 | * | 1/1999 |
| EP | 0 273 688 | | 7/1999 |
| GB | 94 19 091 | | 3/1996 |
| JP | 58/217598 | | 12/1983 |
| WO | WO9013533 | | 11/1990 |
| WO | WO92/18542 | | 10/1992 |
| WO | WO93/08251 | | 4/1993 |
| WO | WO93/16110 | | 8/1993 |
| WO | WO94/28030 | | 12/1994 |
| WO | WO95/07303 | | 3/1995 |
| WO | WO95/07331 | | 3/1995 |
| WO | WO95/12619 | | 5/1995 |
| WO | WO95/19953 | | 7/1995 |
| WO | WO95/19954 | | 7/1995 |
| WO | WO95/19955 | | 7/1995 |
| WO | WO95/20608 | | 8/1995 |
| WO | WO97/34977 | | 9/1997 |
| WO | WO98/54289 | | 12/1998 |

OTHER PUBLICATIONS

Derwent Patent Abstract (WPAT) No. 1996–088228 [10], Feb. 1, 1996.
Derwent Patent Abstract (WPAT) No. 1996–425386 [42], Sep. 12, 1996.
Derwent Patent Abstract (WPAT) No. 1995–269966 [36], Aug. 3, 1995.
Derwent Patent Abstract (WPAT) No. 1987–223150 [32], Aug. 15, 1987.

(List continued on next page.)

*Primary Examiner*—Mark Kopec
*Assistant Examiner*—Brian P. Mruk
(74) *Attorney, Agent, or Firm*—Stephen D. Harper; Glenn E. J. Murphy

(57) ABSTRACT

The invention relates to a process for the production of substantially alumosilicate-free detergents containing a soluble builder system which provides free-flowing and storage-stable granules. In this process for the production of a particulate, substantially alumosilicate-free detergent, an anionic surfactant acid is sprayed onto a detergent component containing anionic surfactant and builders in order to increase the anionic surfactant content.

21 Claims, No Drawings

OTHER PUBLICATIONS

Derwent Patent Abstract (WPAT) No. 1993–152449 [18], Apr. 29, 1993.
Derwent Patent Abstract (WPAT) No. 1993–259656 [33], Aug. 19, 1993.
Derwent Patent Abstract (WPAT) No. 1995–007464 [02], Dec. 8, 1994.
Derwent Patent Abstract (WPAT) No. 1997–351941 [33], Jul. 10, 1997.
Derwent Patent Abstract (WPAT) No. 1994–235530 [29], Jul. 21, 1994.
Derwent Patent Abstract (WPAT) No. 1994–035002 [04], Feb. 10, 1994.
Derwent Patent Abstract (WPAT) No. 1994–280420 [35], Dec. 12, 1995.
Derwent Patent Abstract (WPAT) No. 1996–000404 [01], Nov. 23, 1995.
Derwent Patent Abstract (WPAT) No. 1995–247054 [33], Jul. 6, 1995.
Derwent Patent Abstract (WPAT) No. 1997–472133 [44], Sep. 25, 1997.
Derwent Patent Abstract (WPAT) No. 1985–270605 [44], Dec. 18, 1985.
Derwent Patent Abstract (WPAT) No. 1984–026893 [05], Dec. 17, 1983.
Derwent Patent Abstract (WPAT) No. 1990–336011 [45], Nov. 15, 1990.
Derwent Patent Abstract (WPAT) No. 1995–037121 [06], Jan. 5, 1995.
Derwent Patent Abstract (WPAT) No. 1996–371329 [37], Aug. 8, 1996.
Derwent Patent Abstract (WPAT) No. 1996–456404 [46], Oct. 10, 1996.
Derwent Patent Abstract (WPAT) No. 1997–537244 [50], Nov. 6, 1997.
Derwent Patent Abstract (WPAT) No. 1997–537245 [50], Nov. 6, 1997.
Derwent Patent Abstract (WPAT) No. 1996–287166 [29], Jun. 13, 1996.

* cited by examiner

METHOD OF MANUFACTURING A DETERGENT WITH SOLUBLE BUILDER

This invention relates to a process for the production of detergents which contain a soluble builder system and which are substantially free from alumosilicates.

Builders are now among the most important classes of substances for building detergents and cleaners. The principal requirements builders are expected to satisfy include, above all, the softening of water, the boosting of the detergent effect, the inhibition of redeposition and the suspension of soil. Builders are intended to contribute towards the alkalinity required for the washing process, to have a high absorption capacity for surfactants, to improve the effectiveness of the surfactants, to make positive contributions to the properties of the solid products, for example in powder form, and thus to have a structure-forming effect or even to ease the dust problem. These various requirements cannot normally be satisfied by only one builder component alone, so that a system of builders and cobuilders is generally used.

Alumosilicates, particularly the water-insoluble sodium alumosilicate zeolite NaA, are widely used in detergents. Although these zeolites do require the use of cobuilders, such as polymeric polycarboxylates, above all to prevent incrustations, they are eminently suitable as carriers for surfactants.

Numerous processes which utilize the carrier function of alumosilicates for incorporating surfactants in powder-from detergents are known from the prior art. These compositions can be produced by spray drying processes, which start out from zeolite and surfactant-containing slurries, and by granulation processes in which solids, especially zeolites, are treated with liquid or paste-like surfactant preparations. If zeolite-reduced or even zeolite-free detergents are to be produced, the problem arises that the physical properties of the compositions, such as their storage stability and flowability, deteriorate with decreasing zeolite content. The products tend to become sticky on account of the surfactant content.

DE-A-44 42 977 is concerned with zeolite-reduced detergents. The extruded detergents produced in accordance with this document, which have bulk densities above 600 g/l, contain anionic and optionally nonionic surfactants and water-soluble builders, such as sodium carbonate and amorphous sodium silicate, in such quantities that zeolite can be completely or partly replaced without any process-related problems in the production of these detergents by extrusion. To achieve this, the zeolite content (based on water-free active substance) is limited to an average of less than 19% by weight and the combined sodium carbonate and amorphous sodium silicate content (based on water-free active substance) is adjusted to a value of 10 to 40% by weight, the ratio by weight of sodium carbonate to sodium silicate being from 5:1 to 1:10 and the sodium carbonate used being at least partly granular.

According to International patent application WO 98/54289, free-flowing powders with a high surfactant and low builder content, more especially a low zeolite content, are obtained by at least partly replacing the basic granules by separate granules which contain individual ingredients in highly concentrated form. Preferred detergents are made up of anionic surfactant granules containing at least 60% by weight of anionic surfactant, nonionic surfactant granules containing at least 20% by weight of nonionic surfactant and builder granules containing at most 10% by weight of surfactant.

Earlier German patent application 198 58 887.9 describes a process for the production of a detergent compactate with a bulk density above 700 g/l in which an aqueous preparation of an amorphous sodium silicate with an $Na_2O:SiO_2$ ratio (modulus) of 1:2 to 1:3.3 and a polymeric polycarboxylate (M=500 to 10,000 g/mol) is sprayed together with other detergent ingredients in a dryer and optionally granulated at the same time. The resulting basic detergent is compacted after the optional addition of other ingredients. The silicatelpolymer slurry is preferably spray-dried and compacting is carried out by extrusion. The detergents thus produced are zeolite-reduced or totally zeolite-free and, instead, contain an amorphous silicate in quantities of 15 to more than 20% by weight and small quantities of soda as their principal builder.

A process in which a detergent containing a soluble builder system with alkali metal carbonate as the main builder is obtained in the form of free-flowing storage-stable granules has never been described in the literature. Earlier German patent application 1999 12 679.8 describes a phosphate- and alumosilicate-free detergent. Besides the main builder, alkali metal carbonate, the detergent contains silicates, phosphonates, polymeric polycarboxylates with a molecular weight of <10,000 g/mol and optionally an acidic component in the soluble builder system. The advantages of this soluble builder system include its excellent solubility, its better residue behavior compared with zeolite-containing detergents and improved inhibition of soil redeposition. In addition, this builder system can be used in small doses in relation to the surfactant content of the detergent and is thus particularly suitable for high-surfactant detergents.

High-surfactant, builder-reduced detergents are particularly susceptible to production problems, the builders used additionally having even poorer carrier properties than the traditional zeolites. If the processes recommended in the prior art for zeolite-containing detergents are used to produce such a detergent, the products flow poorly, form lumps in storage and, accordingly, are difficult to dispense into the washing machine.

A process for the production of substantially alumosilicate-free detergents containing a soluble builder system which provides free-flowing and storage-stable granules has now been found.

In a first embodiment, therefore, the present invention relates to a process for the production of a particulate, substantially alumosilicate-free detergent in which an anionic surfactant acid is sprayed onto a detergent component which contains anionic surfactant and builders in order to increase the anionic surfactant content.

Processes in which anionic surfactant acids are added in at least two different process steps are particularly preferred. In one particularly advantageous embodiment, the anionic surfactant acid is sprayed onto the detergent component containing anionic surfactant and builders in a mixer. In this case, spraying on of the anionic surfactant acid is preferably accompanied by granulation.

In another preferred embodiment, the detergent component containing anionic surfactant and builders consists of spray-dried basic granules.

In a preferred variant of this embodiment, a) a slurry containing detergent components suitable for spray drying is sprayed in a drying tower and dried to a water content of at most 20% by weight, b) the spray-dried basic granules are mixed with an alkali metal salt, c) an anionic surfactant acid is sprayed onto the mixture and d) other granules are optionally added to and mixed with the compound.

Acidic precursors, such as anionic surfactant acids, phosphonic acids and optionally acidic or partially neutralized polymers treated with a neutralizing agent are preferably used in the slurry. Preferred neutralizing agents are alkali metal hydroxides, more especially sodium hydroxide, or alkali metal carbonate, more especially sodium carbonate. In addition to these neutralized ingredients, the slurry normally already contains the alkali metal silicate, parts of the alkali metal carbonate and optionally sodium sulfate. The water content of the slurries used for spray drying is normally in the range from 20 to 50%. Preparation of the slurry and spray drying may be carried out as described in European patent application EP-A-0 273 688. In another preferred embodiment, however, the heat of neutralization released during the neutralization of the acidic precursors may be directly used to heat the slurries.

The anionic surfactants which may be used in the process in the form of their acid precursors include in particular sulfonates and sulfates, but also soaps.

Preferred surfactants of the sulfonate type are $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products.

Other suitable surfactants of the sulfonate type are the alkane sulfonates obtained from $C_{12-18}$ alkanes by sulfochlorination or sulfoxidation and subsequent hydrolysis or neutralization.

The esters of α-sulfofatty acids (ester sulfonates), for example the α-sulfonated methyl esters of hydrogenated coconut oil, palm kernel oil or tallow fatty acids, which are obtained by α-sulfonation of the methyl esters of fatty acids of vegetable and/or animal origin containing 8 to 20 carbon atoms in the fatty acid molecule and subsequent neutralization to water-soluble monosalts are also suitable. The esters in question are preferably the α-sulfonated esters of hydrogenated cocofatty acid, palm oil fatty acid, palm kernel oil fatty acid or tallow fatty acids, although sulfonation products of unsaturated fatty acids, for example oleic acid, may also be present in small quantities, preferably in quantities of not more than about 2 to 3% by weight. α-Sulfofatty acid alkyl esters with an alkyl chain of not more than 4 carbon atoms in the ester group, for example methyl esters, ethyl esters, propyl esters and butyl esters, are particularly preferred. The methyl esters of α-sulfofatty acids (MES) and saponified disalts thereof are used with particular advantage.

Other suitable anionic surfactants are sulfonated fatty acid glycerol esters, i.e. the monoesters, diesters and triesters and mixtures thereof which are obtained where production is carried out by esterification by a monoglycerol with 1 to 3 mol of fatty acid or in the transesterification of triglycerides with 0.3 to 2 mol of glycerol.

Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates and $C_{12-15}$ alkyl sulfates and also $C_{14-15}$ alkyl sulfates alkyl sulfates are particularly preferred from the washing performance point of view. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN®.

The sulfuric acid monoesters of linear or branched $C_{7-21}$ alcohols ethoxylated with 1 to 6 mol of ethylene oxide, such as 2-methyl-branched $C_{9-11}$ alcohols containing on average 3.5 mol of ethylene oxide (EO) or $C_{12-18}$ fatty alcohols containing 1 to 4 EO, are also suitable. In view of their high foaming capacity, they are normally used in only relatively small quantities, for example in quantities of 1 to 5% by weight, in detergents.

Other preferred anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol molecules or mixtures thereof. Particularly preferred sulfosuccinates contain a fatty alcohol molecule derived from ethoxylated fatty alcohols which, considered in isolation, represent nonionic surfactants (for a description, see below). Of these sulfosuccinates, those of which the fatty alcohol molecules are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are fatty acid derivatives of amino acids, for example of N-methyl taurine (taurides) and/or of N-methyl glycine (sarcosides). The sarcosides or rather sarcosinates, above all sarcosinates of higher and optionally mono- or poly-unsaturated fatty acids, such as oleyl sarcosinate, are particularly preferred.

Other suitable anionic surfactants are, in particular, soaps which are preferably used in quantities of 0.2 to 5% by weight. Suitable soaps are, in particular, saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids. The known alkenyl succinic acid salts may also be used together with these soaps or as soap substitutes.

In the process according to the invention, the surfactants mentioned are sprayed onto a detergent component in the form of their acid precursors. Neutralization to the sodium, potassium or ammonium salts or to soluble salts of organic bases, such as mono-, di- or triethanolamine, takes place during the process according to the invention. The anionic surfactants are present in the detergent in the form of their sodium or potassium salts, more particularly in the form of their sodium salts.

In addition, the detergent component onto which the anionic surfactant acids are sprayed also contains anionic surfactants from the classes of compounds mentioned. The original incorporation of the anionic surfactants in this detergent component may be carried out by various possible methods. In particular, the acid precursors may be used here also. In one preferred embodiment, in which the component consists of spray-dried basic granules, the anionic surfactants are introduced via a slurry. It is particularly preferred, as described above, to introduce the anionic surfactants into this slurry in acid form and only to neutralize them in admixture with other detergent components.

The detergents produced by the process according to the invention contain anionic surfactants in quantities of preferably 1 to 30% by weight and more preferably 5 to 25% by weight. The detergents preferably contain alkyl benzenesulfonate, alkyl sulfates or mixtures thereof. In another preferred embodiment, the detergents contain soap in addition to other anionic surfactants. In one preferred variant of the process according to the invention, only one surfactant precursor is sprayed onto the detergent component although the resulting detergent may contain several anionic surfactants. In a particularly preferred embodiment, alkyl benzenesulfonic acid is sprayed on as the surfactant precursor.

If the detergent component consists of spray-dried basic granules, these basic granules preferably already contain the other anionic surfactants. The spray drying process gives basic granules with a water content of at most 20% by weight. In preferred embodiments of the invention, the basic granules are dried during spray drying to a water content of at most 15% by weight and preferably to a water content of at most 12% by weight. In a following step, the spray-dried basic granules are mixed with alkali metal salt. In one preferred embodiment, the alkali metal salt is an alkali metal carbonate or an alkali metal sulfate or an alkali metal phosphate, more particularly an alkali metal tripolyphosphate, or mixtures of these salts. Among these alkali metal salts, the particular sodium salts are preferably used. Alkali metal tripolyphosphate is preferably used when the detergent to be produced is intended to comprise a phosphate-based builder system. If the detergent is intended to contain a bicarbonate/silicate-based builder system, alkali metal carbonate, optionally in the form of a mixture with alkali metal sulfate, is preferably used. In principle, any salts capable of binding water are suitable for addition, although the ratio of basic granules to added salts is preferably at least 5:1, more preferably even at least 10:1 and, in a particularly preferred embodiment, more than 15:1. However, if phosphate is added, it may even be preferable to add all the phosphate in this step. In that case, the ratio of basic granules to added salts is normally 2:1 to 1:1.

More anionic surfactant acid is then sprayed onto this mixture; other ingredients, such as nonionic surfactants, may be additionally sprayed on. In one preferred embodiment, the anionic surfactant acid is sprayed in the form of a mixture with nonionic surfactants. This step is primarily intended to increase the anionic surfactant content of the basic granules. In one preferred embodiment, the steps of mixing with alkali metal salts and spraying on of the anionic surfactant acid are carried out in a mixer. In one particularly preferred embodiment, the anionic surfactant acid is sprayed onto the spray-dried basic granules and, at the same time, granulated in a mixer. Various mixer/granulators may be used as the mixer. Suitable mixer/granulators are, for example, Eirich® mixers, Lödige mixers, for example L ödige plowshare mixers, and Schugi mixers. Suitable plowshare mixers preferably have speeds of 2 to 7 m/s as the peripheral speed of the mixing elements while other suitable mixers have peripheral speeds of 3 to 50 m/s and, more particularly, in the range from 5 to 20 m/s. Mixers suitable for carrying out this process step are, for example, Eirich® Series R or RV mixers (trademarks of Machinenfabrik Gustav Eirich, Hardheim), the Schugi® Flexomix, Fukae® FS-G mixers (trademarks of Fukae Powtech, Kogyo Co., Japan), Lödige® FM, KM and CB mixers (trademarks of L ödige Maschinenbau GmbH, Paderbom) and Drais® Series T or K-T. mixers (trademarks of Drais-Werke GmbH, Mannheim).

In preferred embodiments, not only the anionic surfactant content, but also the particle density of the granules increases during the compounding of the spray dried basic granules. In one preferred embodiment of the invention, the spray-dried basic granules have a bulk density of 300 to 600 g/l whereas the compound has a high bulk density compared with the basic granules after the anionic surfactant acid has been sprayed on. Depending on the process conditions, however, it may even be that, although the particle density of the spray-dried basic granules increases during compounding, their bulk density remains the same or even decreases on account of the surface quality of the particles. In preferred embodiments, however, particle density and bulk density both increase. In one particularly preferred embodiment, bulk density increases during compounding by at least 50 g/l and preferably by at least 100 g/l. After the optional addition of other granules of detergent ingredients, the resulting detergents normally have a bulk density in the range from 400 to 900 g/l, typical bulk densities being 500 to 800 g/l. Bulk densities above 550 g/l are particularly preferred. The granules added include in particular compounds containing nonionic surfactants and/or compounds containing bleaching agents.

The present invention also relates to a particulate substantially alumosilicate-free detergent which is characterized in that it contains basic granules which are substantially spray-dried, but the anionic surfactant content of which was further increased after spray drying.

This detergent is produced as described in the foregoing. Besides the anionic surfactants likewise already described, the detergent contains other typical detergent ingredients but more especially a substantially alumosilicate-free builder system. This builder system is preferably a soluble builder system.

In one preferred embodiment, the builder system is a soluble builder system of the type described in earlier German patent application 19912679.8. It consists essentially of an alkali metal silicate with a ratio of $M_2O:SiO_2$ (modulus), where M is an alkali metal ion, of 1:1.7 to 1:3.3, alkali metal carbonate, a polymeric polycarboxylate with a molecular weight below 10,000 g/mol, a phosphonate capable of complexing and optionally an acidic component.

In another preferred embodiment, the builder system is a soluble builder system essentially consisting of an alkali metal silicate with a ratio of $M_2O:SiO_2$ (modulus), where M is an alkali metal ion, of 1:1.7 to 1:3.3, alkali metal carbonate, oxidatively modified oligosaccharide, a phosphonate capable of complexing and optionally an acidic component. A corresponding builder system is described in a co-pending patent application.

The oxidatively modified saccharide to be used in accordance with the invention is a compound selected from the class of oxidized starches or starch derivatives, more particularly thermally or enzyme-degraded starch derivatives. Like glycogen or cellulose, starch is a homoglycan. Starch consists of three different D-glucopyranose polymers, amylose, amylopectin and a so-called intermediate fraction, which is also known as anormal amylopectin, and water (ca. 20%, according to type and storage conditions), relatively small quantities of protein, fats and phosphoric acid in an ester-like linkage. The content of these various constituents in the starch varies according to type. Higher plants contain 0 to 40% of amylose, based on the dry matter. Structurally, the intermediate fraction stands between amylose and amylopectin. In starch analyses, the intermediate fraction is mostly assigned to amylopectin.

Amylose consists of predominantly linear α-1,4-glycosidic D-glucose. Diffusion amylose is the term used for that part of the amylose which is soluble in water at temperatures below 100° C. Diffusion amylose free from amylopectin is obtained at temperatures of 60 to 7° C. Starch containing more than 70% of amylose is known as high-amylose starch, for example pea pulp starch (70% amylose) and amylocorn starch (>50% amylose). The water and amylose content of starch is determined by NIR spectroscopy. The chains form double helices.

Besides the α-1,4 links described for amylose, amylopectin also contains 4 to 6% of α-1,6 links:

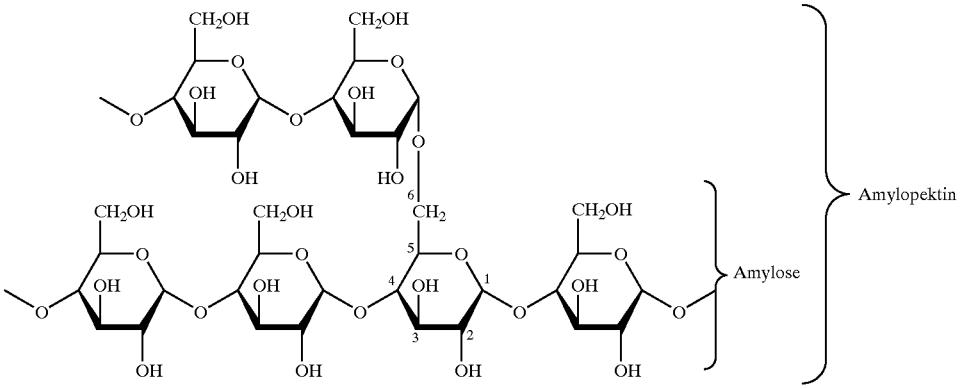

The average interval between the branch points is about 12 to 17 glucose units. The molecular weight ($M_R$=107–108) corresponds to around 105 glucose units, so that amylopectin belongs to the largest biopolymers. The branches are distributed over the molecule in such a way that a cluster structure with relatively short side chains is formed. Two of these side chains together form a double helix. By virtue of the numerous branch points, amylopectin dissolves relatively easily in water and is better degraded by enzymes. The crystallinity of a starch granule and the gelatinization energies increase with increasing amylopectin content. Starches which contain only amylopectin (from certain corn and potato varieties) are known as waxty varieties. The appearance of the starch granules is typical of the particular source plant. Amylose provides complexes in which organic or other molecules are incorporated in the helix structure. With iodine, it forms the blue colored iodine/starch complex of which the absorption maximum is dependent on the chain length of the amylose. Amylopectin forms a reddish-brown complex with iodine. Amylose can be separated from amylopectin by adding n-butanol to a hot starch dispersion. The amylose/n-butanol complex precipitates on cooling.

Starch is a reserve carbohydrate which many plants store in various parts in the form of 1–200 mm large starch grains, for example in tubers or roots [potatoes, arrowroot, cassava, (tapioca), sweet potatoes], in cereal seed (wheat, corn, rye, rice, barley, millet, oats, sorghum), in fruits (chestnuts, acorns, peas, beans and other pulses, bananas) and in pulp (sago palm).

Starch from vegetable raw materials is preferably obtained from flour of corn, potatoes, wheat, rice and cassava (tapioca), the starch granules being mechanically released from the cell structure by the wet method after removal of the gluten. World-wide, corn is the most important source crop for starch.

In principle, oxidation processes on starch or starch derivatives, more particularly starch pyrolyzates or enzymatic degradation products of starch, may be carried out with any suitable oxidizing agent. Terminal aldehyde groups may be oxidized to acid functions and/or alcohol functions may be oxidized to aldehyde or acid functions. However, preferred oxidatively modified starch derivatives essentially contain only alcohol and acid functions. The presence of aldehyde functions is undesirable in the starch derivatives preferably used in accordance with the present invention. In principle, however, oxidized starches also include dialdehyde starches which accumulate in the treatment of starches with selective oxidizing agents, for example periodic acid. However, these polymers tend to crosslink and form water-insoluble films. Accordingly, their use in detergents according to the invention is not preferred and is only possible in combination with very specific ingredients. If these dialdehyde starches are further oxidized to dicarboxy starches, in which units of the following type:

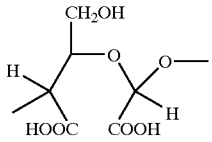

are present as a complexing group, such compounds may very well be present in the detergents according to the invention.

Broadly speaking, various oxidizing agents are commonly used for oxidizing polysaccharides, more especially polyglucosans made up exclusively of glucose. These include, for example, (atmospheric) oxygen, hydrogen peroxide, sodium hypochlorite or bromite, periodic acid or periodates, lead(IV) acetate, nitrogen dioxide and cerium(IV) salts. These oxidizing agents react very differently with the anhydroglucose units. For example, periodates or lead(IV) acetate promote C—C cleavage of the anhydroglucose rings. So-called 2,3-dialdehyde cellulose is obtained from cellulose and dialdehyde starch is similarly obtained from starch. In addition, it is known that, where cellulose is exposed to the action of nitrogen dioxide, oxidation of the primary alcohol group to the carboxyl group is by far the dominant reaction. The oxidizing agent, which is generally present in equilibrium with dinitrogen tetroxide, may be used either in gaseous form or in the form of a solution in an inert organic solvent. Even where starch is the starting material, the primary alcohol groups of the anhydroglucose units can also be largely selectively oxidized to the carboxyl group. Thus, the oxidation of starch with gaseous nitrogen dioxide or with nitrogen dioxide dissolved in water or in various organic solvents is known from U.S. Pat. No. 2,472,590.

Under these conditions, the substantially complete conversion of the primary alcohol groups or the polysaccharides into carboxyl groups is only achieved after very long reaction times which, in some cases, can amount to several days. In addition, large quantities of nitrogen dioxide, based on the polysaccharide to be oxidized, are required in the known processes. A significant improvement in the production of such polysaccharide oxidation products is known from International patent application WO 93/16110. The invention disclosed in that document is based on the discovery that polycarboxylates can be obtained in high yields from polysaccharides by a simple process in which the oxidation reaction with nitrogen dioxide/dinitrogen tetroxide is carried out in the presence of oxygen at elevated temperatures and preferably at elevated pressures. The words "nitrogen dioxide/dinitrogen tetroxide" stand for the equilibrium mixture of nitrogen dioxide and its dimer, dinitrogen tetroxide, which is present under the particular reaction conditions.

If the variant of suspension-medium-free and solvent-free oxidation described in this document is carried out with gaseous nitrogen dioxide/dinitrogen tetroxide, a solid polysaccharide selectively oxidized at $C_6$ is obtained. This sparingly water-soluble acid form is not preferred for direct use as a builder or builder component (co-builder) in detergents. In general, it is preferred to use the oxidized polysaccharide in the form of a water-soluble salt, i.e. the neutralization product of the polycarboxylic acid obtained in the oxidation process. This neutralization may be carried out with aqueous base. Where this procedure is adopted, aqueous solutions of the polycarboxylate are obtained so that an energy-intensive drying step has to be carried out to obtain the polycarboxylate as a solid. This may be acceptable in the production of solid detergents where an "aqueous" working-up step is included for the removal of nitrate and nitrite immediately after the actual oxidation reaction and the further processing of the aqueous neutralized polycarboxylate solution in spray drying processes. The accumulation of aqueous polycarboxylate solutions is a disadvantage in the production of detergents by processes which involve the mixing of solid components because the removal of water from the polycarboxylate solution and the conversion of the dissolved polycarboxylate into a solid is unavoidable in their case.

In a preferred process variant described in German patent application DE-A-44 26 443, which eliminates the need both for the "aqueous" working-up of the reaction products of polysaccharides with nitrogen dioxide/dinitrogen tetroxide and for their vacuum treatment, but which still gives products having acceptably low nitrate and nitrite contents providing the supply of the oxidizing agent nitrogen dioxide/dinitrogen tetroxide is terminated before the end of the actual oxidation reaction and the temperature is increased to a value above the reaction temperature, the aqueous neutralization of the polycarboxylic acid thus produced and the subsequent drying of the aqueous polycarboxylate solution appear almost paradoxical.

Accordingly, a process for the production of solid polycarboxylic acid salts from polysaccharides by oxidation with gaseous nitrogen dioxide/dinitrogen tetroxide, the primary alcohol groups of the polysaccharides being at least partly converted into carboxyl groups and the carboxylic acid groups formed being at least partly neutralized, characterized in that the solid polycarboxylic acid is mixed with a solid neutralizing agent, is particularly preferred. This process is described in German patent application DE-A-195 07 717.

In this process, the oxidation of the polysaccharide preceding the neutralization step is preferably carried out as described in German patent application DE-A-44 26 443. This means that the reaction of the polysaccharide to be oxidized with nitrogen dioxide/dinitrogen tetroxide is only continued until only at most 90%, preferably 60% to 85% and more preferably 65% to 80% of the required degree of oxidation, i.e. the degree of conversion of the primary alcohol groups into carboxyl groups, has been achieved. The required degree of oxidation is only fully achieved in the post-oxidation phase, i.e. after the supply of nitrogen dioxide/dinitrogen tetroxide has been terminated and the temperature has been increased by at least 10° C., preferably by 15° C. to 80° C. and more preferably by 20° C. to 50° C. in relation to the oxidation phase. It is important in this connection to ensure that an upper temperature limit of 160° C. is not exceeded by the increase in temperature because decomposition has increasingly been observed at higher temperatures.

The oxidation reaction, which has to be terminated before the conversion is complete, is preferably carried out at temperatures of 30° C. to 70° C. and more preferably at temperatures of 40° C. to 60° C. Oxygen may be present either on its own or in the form of a mixture with a gas which is inert under the reaction conditions and which may be added either all at once at the beginning of the reaction or several times, if desired continuously, during the reaction. Where the second of these two alternatives is adopted, the oxidation reaction may be controlled through the introduction of oxygen as a function of temperature or pressure. The addition of oxygen is preferably controlled in such a way that the reaction temperature stays in the range from 30° C. to 70° C.

Suitable inert gases, i.e. gases which do not react under the particular process conditions applied, include noble gases, such as helium or argon, and carbon dioxide, but especially nitrogen, nitrogen monoxide and dinitrogen monoxide and mixtures thereof. The oxygen content in the gas mixture is preferably in the range from 1% by volume to 30% by volume and more preferably in the range from 3% by volume to 10% by volume. In one preferred embodiment of the process according to the invention, the oxygen is introduced in the form of air under pressure.

Another preferred embodiment of the process is characterized in that a pressure of less than 10 bar and, more particularly, a pressure of 2 bar to 6 bar at the required reaction temperature is adjusted in the reaction system before the beginning of the oxidation reaction by introducing one of the above-mentioned inert gases under pressure and then adding oxygen or a mixture of oxygen with one of the inert gases mentioned, repeatedly, if desired continuously, under pressure. Nitrogen dioxide/dinitrogen tetroxide may be added before or after the oxygen or before or after the beginning of the addition of the oxygen. It may be necessary to heat the reaction vessel to the required reaction temperature after the initial introduction of the inert gas under pressure. During the oxidation reaction, which is preferably carried out with intensive mixing of the reactants, the reaction temperature may generally be maintained solely by the amount of oxygen added, i.e. without any need for external heating.

In the oxidation step of the process according to the invention, the oxidizing agent acts directly from the gas phase on the solid, intensively mixed polysaccharide substrates. The oxidation is preferably carried out in a fluidized bed of polysaccharide where the fluidizing agent is a gas containing nitrogen dioxide. One such oxidation process is described in German patent application DE-A-44 02 851. In the present context, a fluidized bed is understood to be the phenomenon observed when gases known as fluidizing agents flow from beneath through a layer of loose fineparticle material on horizontal perforated plates. However, the invention is by no means limited to this particular method of generating the fluidized bed.

A particularly preferred class of oxidatively modified oligosaccharides are oxidized dextrin derivatives. Dextrins are, for example, oligomers or polymers of carbohydrates which can be obtained by partial hydrolysis of the starches. The hydrolysis may be carried out by standard processes, for example acid- or enzyme-catalyzed processes. The oligomers of polymers are preferably hydrolysis products with average molecular weights in the range from 400 to 500,000 g/mol. A polysaccharide having a dextrose equivalent (DE) in the range from 0.5 to 40 and more particularly in the range from 2 to 30 is preferably used, DE being a standard measure of the reducing effect of a polysaccharide by comparison with dextrose which has a DE of 100. Both maltodextrins with a DE of 3 to 20 and dry glucose syrups with a DE of 20 to 37 and so-called yellow dextrins and white dextrins with relatively high molecular weights in the range from 2,000 to 30,000 g/mol may be used. A preferred dextrin is described in British patent application 94 19 091. The oxidized derivatives of such dextrins are reaction products thereof with oxidizing agents which are capable of oxidizing at least one alcohol function of the saccharide ring to the carboxylic acid function. Corresponding oxidized dextrins and processes for their production are known, for example, from European patent applications EP-A-0 232 202, EP-A-0 427 349, EP-A-0 472 042 and EP-A-0 542 496 and from International patent applications WO 92/18542, WO 93/08251, WO 93/16110, WO 94/28030, WO 95/07303, WO 95/12619 and WO 95/20608.

An oxidized oligosaccharide according to German patent application DE-A-196 00 018 is also preferred. The preferred monomer in this oligosaccharide, which is preferably used after oxidative modification for the purposes of the invention, is glucose. The average degree of oligomerization, which—as an analytically determined quantity—may even be a broken number, is preferably in the range from 2 to 20 and more preferably in the range from 2 to 10. The oligosaccharide preferably used as a builder or co-builder has been oxidatively modified at its originally reducing end with the loss of 1 carbon atoms. If the originally reducing end of the oligosaccharide had been an anhydroglucose unit, an arabinonic acid unit would be present after the modification: $(\text{glucose})_{n+1} \rightarrow (\text{glucose})_n$ arabinonic acid.

This oxidative modification may be carried out, for example, using Fe, Cu, Ag, Co or Ni catalysts as described in International patent application WO 92/18542, using Pd, Pt, Rh or Os catalysts as described in European patent EP 0 232 202 or using a quinone/hydroquinone system in the alkaline range in conjunction with oxygen, optionally followed by aftertreatment with hydrogen peroxide. The oligosaccharide starting material modifiable by oxidation processes such as these is preferably an oligosaccharide with a dextrose equivalent (DE) of 20 to 50. So-called glucose syrups (DE 20–37) and the above-mentioned dextrins, which can both be obtained by partial hydrolysis of starch by standard processes, for example acid- or enzyme-catalyzed processes, and which may be used either as such or in the form of higher polymers, for example as starch, in the oxidation processes mentioned above providing the polymer chain structure of the starch also undergoes corresponding degradation under the oxidation conditions, are particularly suitable. The oligosaccharides thus oxidatively modified preferably have a —COOH group instead of the —CH(OH)—CHO group at the originally reducing end.

The detergents according to the invention preferably contain 0.5% by weight to 8% by weight and more preferably 2% by weight to 6% by weight of the oxidatively modified oligosaccharide which is normally used in the form of its alkali metal salt. Concentrations of oxidatively modified oligosaccharide in the wash liquor of 0.001% by weight to 0.05% by weight are preferred for the purposes of the use according to the invention and the washing process according to the invention.

In one particularly preferred embodiment, the soluble builder system according to one of the described embodiments makes up less than 40% by weight of the detergent as a whole and the alkali product of the detergent is in the range from 7.0 to 11.4.

The alkali product is a quantity which is indicative of the alkalinity of detergents. The alkali product is determined by pH titration of a 10% by weight solution of the detergent in water using a pH electrode and 1.0 molar hydrochloric acid. The alkali product is calculated as follows:

$$\text{Alkali product} = \frac{10 \cdot 0.4 \cdot V}{E \cdot 6} + \textit{initial pH}$$

where

V is the consumption of 1.0 molar HCl at pH 10 (in ml)

E is the sample weight in g initial pH is the pH of the 10% by weight solution.

If the alkali product is above 10, it may be regarded as indicative of the initial pH and the buffer capacity of the solution. If it is below 10, it is identical with the initial pH and cannot be taken as an indication of the buffer behavior of the solution.

The alkali product of the detergents according to the invention is in the range from 7.0 to 11.4 and preferably in the range from 8.5 to 11.2. In one particularly preferred embodiment of the invention, the detergent has an alkali product of 10.7±0.4.

The alkali metal carbonates normally used in the builder system are preferably sodium and/or potassium carbonate, sodium carbonate being particularly preferred. The content of these alkali metal carbonates is preferably selected so that the content of alkali metal carbonate active in the wash liquor makes up from 10 to 30% by weight and, in a particularly preferred embodiment, 15 to 25% by weight of the detergent as a whole.

The polymeric polycarboxylates are preferably homopolymers or copolymers containing acrylic acid and/or maleic acid units. A particularly preferred embodiment of the invention is characterized by the use of homopolymers, preferably polyacrylates. The polyacrylates are normally used in the form of sodium salts. Polyacrylates preferably having a molecular weight of 3,000 to 8,000 and, more preferably, in the range from 4,000 to 5,000 g/mol have proved to be particularly suitable for the purposes of the invention. The molecular weights mentioned in this specification for polymeric polycarboxylates are weight-average molecular weights $M_W$ which, basically, were determined by gel permeation chromatography (GPC) using a UV detector. The measurement was carried out against an external polyacrylic acid standard which provides realistic molecular weight values by virtue of its structural similarity to the polymers investigated. These values differ distinctly from the molecular weights measured against polystyrene sulfonic acids as standard. The molecular weights measured against polystyrene sulfonic acids are generally higher than the molecular weights mentioned in this specification. The polymeric polycarboxylates are present in the detergent in quantities of preferably 0.5 to 8%. by weight and, more preferably, 2 to 6.5% by weight.

The detergents according to the invention may also contain the copolymeric polycarboxylates normally used as co-builders, more particularly copolymers of acrylic acid with methacrylic acid and copolymers of acrylic acid or methacrylic acid with maleic acid which have a molecular weight of 20,000 to 70,000 g/mol. Acrylic acid/maleic acid copolymers containing 50 to 90% by weight of acrylic acid and 50 to 10% by weight of maleic acid have proved to be particularly suitable. In order to improve solubility in water, the polymers may also contain allyl sulfonic acids, such as allyloxybenzene sulfonic acid and methallyl sulfonic acid. (cf. EP-B-727 448), as monomer. Other particularly preferred polymers are biodegradable polymers of more than two different monomer units, for example those which contain salts of acrylic acid and maleic acid and vinyl alcohol or vinyl alcohol derivatives as monomers according to DE-A 43 00 772 or those which contain salts of acrylic acid and 2-alkylallyl sulfonic acid and sugar derivatives as monomers according to DE-C-42 21 381. Other preferred copolymers are those which are described in German patent applications DE-A-43 03 320 and DE-A-44 17 734 and which preferably contain acrolein and acrylic acid/acrylic acid salts or acrolein and vinyl acetate as monomers. In one preferred variant, both these copolymers and the polyacrylates described above are used in the process, the ratio of polyacrylate to acrylic acid/maleic acid copolymer being in the range from 2:1 to 1:20 and preferably in the range from 1:1 to 1:15. However, the content of these long-chain polycarboxylates in the detergents is preferably at most 5% by weight. In another equally preferred embodiment of the invention, the detergents contain no other polymer of acrylic acid and, in particular, no copolymer of acrylic acid with maleic acid apart from the polymeric polycarboxylate with a molecular weight below 10,000 g/mol.

The described homopolymers and copolymers of -acrylic acid suitable as co-builders may also be present in the form of a mixture with the oxidatively modified oligosaccharides described above. In individual embodiments, mixtures of homopolymeric polyacrylic acid with oxidatively modified oligosaccharides and mixtures of the described copolymers with these polysaccharides are preferred.

In preferred embodiments of the invention, the alkali metal silicates are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not product any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-4400024. Compacted amorphous silicates, compounded amorphous silicates and overdried X-ray-amorphous silicates are particularly preferred. Granular amorphous silicates having bulk densities of at least 700 g/l can be produced, for example, by the process described in patent application WO 97/34977 which is based on spray drying and which includes compaction of the spray-dried beads. To this end, the spray-dried beads are ground and are simultaneously or subsequently granulated in the presence of a liquid granulation aid, bulk densities of at least 700 g/l up to more than 1,000 g/l being established.

In one particular embodiment of the invention, the alkali metal silicates may also be used in the form of preparations in which they are present together with alkali metal carbonate.

Another preferred embodiment of the present invention is characterized by the use of crystalline layer-form sodium silicates with the general formula $Na_2Si_xO_{2x+1}\cdot y\ H_2O$, where x is a number of 1.9 to 4 and y is a number of 0 to 20, preferred values for x being 2, 3 or 4. Crystalline layer silicates such as these are described, for example, in European patent application. EP-A-0 164 514. Preferred crystalline layer silicates corresponding to the above formula are those where N is sodium and x has a value of 2 or 3. Both β- and δ-sodium disilicates $Na_2Si_2O_5\cdot yH_2O$ are particularly preferred.

Irrespective of the alkali metal silicate used, the total alkali metal silicate content of the detergents is preferably between 0.5 and 20% by weight and more preferably between 3 and 10% by weight.

Another component of the builder system are phosphonates, more particularly hydroxyalkane and aminoalkane phosphonates. Among the hydroxyalkane phosphonates, 1-hydroxyethane-1,1-diphosphonate (HEDP) is particularly important as a co-builder. It is preferably used in the form of a sodium salt, the disodium salt showing a neutral reaction and the tetrasodium salt an alkaline reaction (pH 9). Preferred aminoalkane phosphonates are ethylenediamine tetramethylene phosphonate (EDTMP), diethylenetriamine pentamethylene phosphonate (DTPMP) and higher homologs thereof. They are preferably used in the form of the neutrally reacting sodium salts, for example as the hexasodium salt of EDTMP and as the hepta- and octasodium salt of DTPMP. Within the class of phosphonates, HEDP is preferably used as builder. The aminoalkane phosphonates also show a pronounced heavy metal binding capacity. Accordingly, it can be of advantage, particularly where the detergents also contain bleaching agents, to use aminoalkane phosphonates, more especially DTPMP, or mixtures of the phosphonates mentioned. Such phosphonates are normally present in the detergents in quantities of 0.05 to 2.0% by weight and preferably in quantities of 0.1 to 1% by weight.

Alumosilicates are present in the detergents in only small quantities, if at all. If they are present, it is not for.their water-softening effect or for their carrier function. They may be present only when they serve as a granulation aid, for example for "powdering". Accordingly, the crystalline alumosilicate content of the detergents is less than 5% by weight and, preferably, even less than 3% by weight. Zeolites A, P, X and Y are preferably used as the alumosilicates. However, mixtures of A, X, Y and/or P are also suitable. A particularly preferred zeolite P is, for example, zeolite MAP (for example Doucil®, a commercial product of Crosfield). A co-crystallized sodium/potassium aluminium silicate of zeolite A and zeolite X, which is commercially available as VEGOBOND AX® (a commercial product of Condea Augusta S.p.A.), is also of particular interest.

Most of the builder components are preferably present in the spray-dried basic granules. In one particularly advantageous embodiment of the invention, alkali metal silicate, polymeric polycarboxylates, phosphonate and at least part of the alkali metal carbonate are present in the spray-dried basic granules. These components may serve as carriers during the spray drying process itself.

In another preferred embodiment of the invention, the detergents contain a phosphate-based builder system. The phosphate used may be trisodium phosphate, tetrasodium diphosphate, disodium dihydrogen diphosphate, pentasodium triphosphate, so-called sodium hexametaphosphate, oligomeric trisodium phosphate with degrees of oligomerization of 5 to 1,000 and more particularly 5 to 50 and mixtures of sodium and potasium salts. However, pentasodium triphosphate—also known as sodium tripolyphosphate or STP or STPP for short—is particularly preferred.

Besides these components crucial to the invention, the detergents may contain other typical detergent ingredients. These include in particular cationic, zwitterionic and amphoteric surfactants, but above all nonionic surfactants.

Preferred nonionic surfactants are alkoxylated, advantageously ethoxylated, more particularly primary alcohols preferably containing 8 to 18 carbon atoms and an average of 1 to 12 mol of ethylene oxide (EO) per mol of alcohol, in which the alcohol moiety may be linear or, preferably, 2-methyl-branched or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil fatty alcohol, palm oil fatty alcohol, tallow fatty alcohol or oleyl alcohol, and an average of 2 to 8 EO per mol of alcohol are particularly preferred. Preferred.ethoxylated alcohols include, for example, $C_{12-14}$ alcohols containing 3 EO or 4 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 7 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used, as described above. Examples of such fatty alcohols are (tallow) fatty alcohols containing 14 EO, 16 EO, 20 EO, 25 EO, 30 EO or 40 EO.

The nonionic surfactants also include alkyl glycosides with the general formula $RO(G)_x$ where R is a primary, linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number—which as an analytically determined quantity may even be a broken number—of 1 to 10 and preferably a number of 1.2 to 1.4.

Other suitable surfactants are polyhydroxyfatty acid amides corresponding to formula (I):

$$R^1\text{—CO—N(}R^2\text{)—[Z]} \qquad \text{(I)}$$

in which $R^1CO$ is an aliphatic acyl radical containing 6 to 22 carbon atoms, $R^2$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxyfatty acid amides are preferably derived from reducing sugars containing 5 or 6 carbon atoms, more particularly from glucose. The group of polyhydroxyfatty acid amides also includes compounds corresponding to formula (II):

$$R^3\text{—CO—N(}R^4\text{—O—}R^5\text{)—[Z]} \qquad \text{(II)}$$

in which $R^3$ is a linear or branched alkyl or alkenyl group containing 7 to 12 carbon atoms, $R^4$ is a linear, branched or cyclic alkylene group or an arylene group containing 2 to 8 carbon atoms and $R^5$ is a linear, branched or cyclic alkyl group or an aryl group or a hydroxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of such a group. Again, [Z] is preferably obtained by reductive amination of a sugar, for example glucose, fructose, maltose, lactose, galactose, mannose or xylose. The N-alkoxy or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

Another class of preferred nonionic surfactants which are used either as sole nonionic surfactant or in combination with other nonionic surfactants, particularly together with alkoxylated fatty alcohols and/or alkyl glycosides, are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533. $C_{12-18}$ fatty acid methyl esters containing on average 3 to 15 EO and, more particularly, 5 to 12 EO are preferred as nonionic surfactants whereas fatty acid methyl esters with a relatively high degree of ethoxylation above all are advantageous as binders, as described above. $C_{12-18}$ fatty acid methyl esters containing 10 to 12 EO may be used both as surfactants and as binders.

Nonionic surfactants of the amine oxide type, for example N-cocoalkyl-N,N-dimethylamine oxide and N-tallowalkyl-N,N-dihydroxyethyl amine oxide, and the fatty acid alkanolamide type are also suitable. The quantity in which these nonionic surfactants are used is preferably no more, in particular no more than half, the quantity of ethoxylated fatty alcohols used.

Other suitable surfactants are so-called gemini surfactants. Gemini surfactants are generally understood to be compounds which contain two hydrophilic groups and two hydrophobic groups per molecule. These groups are generally separated from one another by a so-called "spacer". The spacer is generally a carbon chain which should be long enough for the hydrophilic groups to have a sufficient spacing to be able to act independently of one another. Gemini surfactants are generally distinguished by an unusually low critical micelle concentration and by an ability to reduce the surface tension of water to a considerable extent. In exceptional cases, however, gemini surfactants are not only understood to be dimeric surfactants, but also trimeric surfactants.

Suitable gemini surfactants are, for example, the sulfated hydroxy mixed ethers according to German patent application DE-A-43 21 022 and the dimer alcohol bis- and trimer alcohol tris-sulfates and -ether sulfates according to German patent application DE 195 03 061. The end-capped dimeric and trimeric mixed ethers according to German patent application DE 195 13 391 are distinguished in particular by their bifunctionality and multifunctionality. Thus, the end-capped surfactants mentioned exhibit good wetting properties and are low-foaming so that they are particularly suitable for use in machine washing or cleaning processes.

However, the gemini polyhydroxyfatty amides or poly-polyhydroxyfatty acid amides described in International patent applications WO-A-95/19953, WO-A-95/19954 and WO-A-95/19955 may also be used.

Among the compounds yielding $H_2O_2$ in water which serve as bleaching agents, sodium perborate tetrahydrate, sodium perborate monohydrate and sodium percarbonate are particularly important. Other useful bleaching agents are, for example, peroxypyrophosphates, citrate perhydrates and $H_2O_2$-yielding peracidic salts or peracids, such as perbenzoates, peroxophthalates, diperazelaic acid, phthaloiminoperacid or diperdodecanedioic acid. In one preferred embodiment, sodium percarbonate is used as the bleaching agent, as mentioned above.

The other detergent ingredients include redeposition inhibitors (soil suspending agents), foam inhibitors, bleach activators, optical brighteners, enzymes, fabric softeners, dyes and perfumes and neutral salts, such as sulfates and chlorides in the form of their sodium or potassium salts.

Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran and enol esters and also acetylated sorbitol and mannitol and mixtures thereof (SORMAN), acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam. The substituted hydrophilic acyl acetals known from German patent application DE-A-196 16 769 and the acyl lactams described in German patent application DE-A-196 16 770 are also preferably used. The combinations of conventional bleach activators known from German patent application DE-A-44 43 177 may also be used. Bleach activators such as these are present in the usual quantities, preferably in quantities of 1% by weight to 10% by weight and more preferably in quantities of 2% by weight to 8% by weight, based on the detergent as a whole.

Where the detergents are used in washing machines, it can be of advantage to add typical foam inhibitors to them. Suitable foam inhibitors are, for example, soaps of natural or synthetic origin which have a high percentage content of $C_{18-24}$ fatty acids. Suitable non-surface-active foam inhibitors are, for example, organopolysiloxanes and mixtures thereof with microfine, optionally silanized, silica and also paraffins, waxes, microcrystalline waxes and mixtures thereof with silanized silica or bis-stearyl ethylenediamide. Mixtures of different foam inhibitors, for example mixtures of silicones, paraffins and waxes, may also be used with advantage. The foam inhibitors, more particularly silicone- and/or paraffin-containing foam inhibitors, are preferably fixed to a granular water-soluble or water-dispersible support. Mixtures of paraffins and bis-stearyl ethylenediamides are particularly preferred.

Suitable enzymes are, in particular, enzymes from the class of hydrolases, such as proteases, lipases or lipolytic enzymes, amylases, cellulases and mixtures thereof. Oxidoreductases are also suitable.

Enzymes obtained from bacterial strains or fungi, such as Bacillus subtilis, Bacillus licheniformis, Streptomyces griseus and Humicola insolens are particularly suitable. Proteases of the subtilisin type are preferably used, proteases obtained from Bacillus lentus being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also proved to be suitable in some cases. Suitable amylases include in particular $\alpha$-amylases, isoamylases, pullulanases and pectinases. Preferred cellulases are cellobiohydrolases, endoglucanases and $\beta$-glucosidases, which are also known as cellobiases, and mixtures thereof. Since the various cellulase types differ in their CMCase and avicelase activities, the desired activities can be established by mixing the cellulases in the appropriate ratios.

The enzymes may be adsorbed to supports and/or encapsulated in shell-forming substances to protect them against premature decomposition. The percentage content of enzymes, enzyme mixtures or enzyme granules is preferably from about 0.1 to 5% by weight and more preferably from 0.1 to about 2% by weight.

In addition to or instead of phosphonates, the detergents may contain other enzyme stabilizers. For example, 0.5 to 1% by weight of sodium formate may be used. Proteases stabilized with soluble calcium salts and having a calcium content of preferably about 1.2% by weight, based on the enzyme, may also be used. Apart from calcium salts, magnesium salts also serve as stabilizers. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are also preferably used, for example in quantities of 0.1 to 5% by weight, based on the detergent.

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl6-amino)-stilbene-2,2'-disulfonic acid or compounds of similar structure which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-di phenyl, 4,4'-bis-(4-chloro-3-sulfostyryl)-diphenyl or 4-(4-chlorotyryl)-4'-(2-sulfostyryl)-diphenyl, may also be present. Mixtures of the brighteners mentioned may also be used.

EXAMPLES

A spray-dried tower powder with the composition shown in Table 1 below was prepared for the production of the detergents. To this end, a slurry containing sulfonic acids, fatty acids and phosphonic acids as acidic precursors was reacted with an excess of sodium carbonate. The slurry was then spray-dried. By selecting a suitable slurry composition, tower powders with the composition E according to the invention and with the comparison composition C were obtained (Table 1).

TABLE 1

Composition of the spray-dried tower powder [% by weight]

| Composition | E1 | E2 | E3 |
|---|---|---|---|
| Alkyl benzenesulfonate | 15.0 | 15.0 | 15.0 |
| Soap | 2.0 | 2.7 | 1.8 |
| Sodium carbonate | 30.0 | 40.0 | 15.0 |
| Silicate | 7.0 | 8.0 | 15.0 |
| Polyacrylate | 6.5 | 8.0 | — |
| HEDP | 0.3 | 0.4 | 0.4 |
| Sodium sulfate | 29.5 | 14.0 | 44.0 |
| Water | 9.0 | 11.0 | 6.5 |
| Balance | 0.7 | 0.9 | 2.3 |
| Apparent density [g/] | 330 | 370 | 340 |

Silicate: amorphous sodium silicate with $Na_2O$: $SiO_2$ 2.4
Polyacrylate: Norasol LMW 45N ®, polyacrylic acid, sodium salt, M = 4500 g/mol, a product of NorsoHaas
HEDP: hydroxyethane diphosphonate

TABLE 2

Compounded tower powder [% by weight]

| | E1 | E2 | E3 |
|---|---|---|---|
| Tower powder | 86.5 | 78.0 | 55.0 |
| Arlicon acid | 10.0 | 13.0 | 1.8 |
| $C_{12/18}$ fatty alcohol ethoxylate (EO = 7) | — | 4.0 | 1.25 |
| Sodium carbonate | 2.0 | 2.5 | 1.25 |
| Sodium tripolyphosphate | — | — | 37.5 |
| Sodium sulfate | 1.5 | 2.5 | 3.2 |
| Bulk density (g/l) | 370 | 420 | 430 |

To enrich the tower powder with surfactant, the basic granules were first mixed with sodium carbonate and sodium sulfate or sodium tripolyphosphate in a mixer (Lödige CB mixer). Alkyl benzenesulfonic acid (Arlicon acid) was then sprayed onto the resulting mixture. The nonionic surfactant was additionally sprayed on in E2 and E3. The compounds shown in Table 2 were formed. Other detergent ingredients, such as—in the case of E1 and E3—bleaching agents and perfumes, enzymes and optical brighteners were then added to the compounds. The composition of the resulting detergents is shown in Table 3.

TABLE 3

Composition of the resulting detergents (% by weight)--.

| | E1 | E2 | E3 |
|---|---|---|---|
| Alkyl benzenesulfonate | 12 | 21 | 8 |
| $C_{12/18}$ fatty alcohol ethoxylate (EO = 7) | 2 | 3.5 | 4.2 |
| Soap | 1 | 1.5 | 0.8 |
| Sodium carbonate | 15 | 26 | 8.0 |
| Disilicate 2,4 | 2.5 | 4.5 | — |
| Polyacrylate | 2.5 | 5 | 6.5 |
| HEDP | 0.1 | 0.2 | 0.2 |
| Sodium perborate tetrahydrate | 12 | — | 17 |
| TAED | 4 | — | 2 |
| Sodium sulfate | 42 | 25 | 18.5 |
| Sodium tripolyphosphate | — | — | 30 |
| Water | 4 | 7.5 | 3 |
| Other salts | 5.4 | 5.8 | 1.8 |
| Bulk density [g/l] | 560 | 770 | 450 |

The resulting detergents are free-flowing and storage-stable and can be excellently dispensed into the washing machine. The following tests were carried out with detergents E1 and E2 to determine dispensing and residue behavior.

L Test:

To determine residue behavior and dissolving behavior, 8 g of the detergent to be tested were scattered while stirring into 1 liter of water in a 2 liter glass beaker (laboratory/propeller stirrer head centrally arranged 1.5 cm from the bottom of the glass beaker, stirring speed 800 r.p.m.), followed by stirring for 1.5 minutes at 30° C. The test was carried with water having a hardness of 16° d. The wash liquor was then poured off through an 80 $\mu$m mesh sieve. The glass beaker was rinsed out with a very little cold water above the sieve. A double determination was carried out. The sieves were placed in a dry cabinet and dried to constant weight at 40° C.±2° C. and the detergent residue was weighed out. The residue is expressed in % as the mean value of the two individual determinations. If the individual results differed by more than 20% from one another, further tests were normally carried out although this was not necessary for the purpose of the present investigations.

R Test:

30 Liters of water were first run into a tub-type washing machine (Arcelik), after which 90 g of the detergent were added and dissolved by stirring. The washing consisting of various dark-colored easy-care delicates of wool, cotton, polyamide and polyacrylonitrile was then introduced and the machine was heated to a temperature of 30° C. After this temperature had been reached, the washing was washed for 18 minutes by actuating the agitator, after which the wash liquor was drained off and the washing was rinsed three times with 30 liters of water and spun for 15 seconds. The washing was dried with a infrared dryer and evaluated by 5 trained examiners using the following scale (averages):

| | |
|---|---|
| score 1: | satisfactory, no discernible residues |
| score 2: | acceptable, isolated, harmless residues |
| score 3: | discernible residues troublesome on critical evaluation |
| score 4: | clearly discernible and problematical residues in an increasing number and quantity |

E Test:

In order to determine dispensing behavior, the detergents were tested in domestic drum-type washing machines with a dispensing drawer, water pressure 0.5 bar. The test machine was a Miele W 918. Five determinations were carried out. The average value shown below was then formed from the results. To this end, 80 g of the detergent were introduced into the dispensing compartment per wash cycle. The tap water with which the detergent was dispensed into the particular machine loaded with 3.5 kg of dry washing had a hardness of 16° d. After dispensing, the detergent residues were separately transferred from the dispensing drawer and the dispensing compartment to a watch glass using a rubber blade and weighed out. 30% moisture was subtracted from these moist residues. The "dry residues" from the drawer and the compartment were added and the average value shown in Table 3 was formed from the total.

Lump Test:

The flowability of the detergents according to the invention was tested by a lump test. To this end, 15 ml of the particular compound were measured off into a 25 ml measuring cylinder and transferred to a stainless steel cylinder standing in a porcelain dish. A stainless steel punch was then inserted into the cylinder without compressing the powder and placed under a load of 500 g. After 30 minutes and 24 hours, the weight was removed, the cylinder was lifted and the detergent was forced out by the punch. The test was carried out at room temperature and at 40° C. If the pressing disintegrates on ejection, a lump test score of "0" is awarded. Otherwise a vessel is placed on the dish with the pressing and water is added until the pressing disintegrates. The quantity of water required is shown in grams as the lump test score (Table 4).

TABLE 4

| Results dissolving behavior tests | | | |
|---|---|---|---|
| | E1 | E2 | E3 |
| E test [g] | 0 | 6 | 3 |
| L Test [%] | 4.1 | 4.7 | 4.5 |
| R Test [score] | 2.7 | 3.1 | 3.7 |
| Lump test [g] | 70 | 0 | 0 |

In the all the tests, the detergents investigated produced satisfactory to very good results (as shown in Table 4).

What is claimed is:

1. A process for the production of a particulate, substantially aluminosilicate-free detergent, comprising the steps of spray-drying a slurry comprising an anionic surfactant to form spray-dried basic granules, mixing the basic granules with an alkali metal salt and forming therewith a detergent component, spraying an anionic surfactant acid in liquid form onto the detergent component, and forming a particulate detergent comprising the detergent component, wherein the detergent comprises less than 5% by weight of aluminosilicates.

2. The process of claim 1, wherein the anionic surfactant acid is sprayed onto the detergent component during granulation of the basic granules in a mixer.

3. The process of claim 1, wherein the anionic surfactant acid is sprayed onto the detergent component in the form of a mixture with one or more nonionic surfactants.

4. The process of claim 1, wherein the slurry is spray-dried to a water content of at most 20% by weight.

5. The process of claim 4, wherein the slurry is spray-dried to a water content of at most 15% by weight.

6. The process of claim 5, wherein the slurry is spray-dried to a water content of at most 12% by weight.

7. The process of claim 1, wherein the detergent is formed by mixing the detergent component with a compound containing either or both of a nonionic surfactant and a bleaching agent.

8. The process of claim 1, wherein the slurry is formed with an anionic surfactant acid.

9. The process of claim 1, wherein the spray-dried basic granules have a bulk density of 300 g/l to 600 g/l and the resulting detergent having a bulk density of 400 g/l to 900 g/l.

10. The process of claim 1, wherein the resulting detergent has a bulk density at least 50 g/l higher than the spray-dried basic granules.

11. The process of claim 1, wherein the alkali metal salt comprises an alkali metal carbonate, an alkali metal sulfate, an alkali metal phosphate, or a mixture thereof.

12. The process of claim 11, wherein the alkali metal salt comprises an alkali metal tripolyphosphate.

13. The process of claim 1, wherein the detergent comprises a soluble builder system.

14. The process of claim 13, wherein the soluble builder system comprises one or more co-builders selected from the group consisting of polymeric polycarboxylate with a molecular weight below 10,000 g/mol, copolymeric polycarboxylate with molecular weights of 20,000 to 70,000 g/mol, oxidatively modified oligosaccharide, and mixtures thereof.

15. The process of claim 13, wherein the soluble builder system comprises an alkali metal silicate with a ratio of $M_2O:SiO_2$ of 1:1.7 to 1:3.3, where M is an alkali metal ion, alkali metal carbonate, a polymeric polycarboxylate with a molecular weight below 10,000 g/mol, a phosphonate capable of complexing, and optionally an acidic component.

16. The process of claim 13, wherein the soluble builder system comprises an alkali metal silicate with a ratio of $M_2O:SiO_2$ of 1:1.7 to 1:3.3, where M is an alkali metal ion, alkali metal carbonate, oxidatively modified oligosaccharide, a phosphonate capable of complexing, and optionally an acidic component.

17. The process of claim 13, wherein the soluble builder system comprises less than 40% by weight of the detergent as a whole and the detergent has an the alkali product in the range of 7.0 to 11.4.

18. The process of claim 1, wherein the slurry comprises one or more alkali metal silicates, polymeric polycarboxylates, oxidatively modified oligosaccharides, phosphonates, or alkali metal carbonates.

19. The process of claim 1, wherein the detergent comprises 0.5% to 20% by weight of one or more alkali metal silicates, a quantity of alkali metal carbonate or carbonates such that active alkali metal carbonate in a wash liquor is from 10% to 30% by weight of the wash liquor, 0.5% to 8% by weight of one or more polymeric polycarboxylates or oxidatively modified oligosaccharides, 0.05% to 2.0% by weight of one or more phosphonates, and up to 10% by weight of one or more acidic components.

20. The process of claim 19, wherein the detergent comprises 3% to 10% by weight of one or more alkali metal silicates, a quantity of alkali metal carbonate or carbonates such that active alkali metal carbonate in a wash liquor is from 15% to 25% by weight of the wash liquor, 2% to 6.5% by weight of one or more polymeric polycarboxylates or oxidatively modified oligosaccharides, 0.1% to 1% by weight of one or more phosphonates, and 0.1% to 5% by weight of one or more acidic components.

21. The process of claim 19, wherein the detergent comprises a builder system based on sodium tripolyphosphate.

* * * * *